US009167343B2

(12) United States Patent
Kanatsu et al.

(10) Patent No.: US 9,167,343 B2
(45) Date of Patent: Oct. 20, 2015

(54) CONDENSER STEREOMICROPHONE

(71) Applicants: Ryo Kanatsu, Tokyo (TW); Kai Ti Lin, Tokyo (TW)

(72) Inventors: Ryo Kanatsu, Tokyo (TW); Kai Ti Lin, Tokyo (TW)

(73) Assignee: Kabushiki Kaisha Audio-Technica, Tokyo (JP)

( * ) Notice: Subject to any disclaimer, the term of this patent is extended or adjusted under 35 U.S.C. 154(b) by 40 days.

(21) Appl. No.: 14/174,880

(22) Filed: Feb. 7, 2014

(65) Prior Publication Data

US 2014/0241530 A1 Aug. 28, 2014

(30) Foreign Application Priority Data

Feb. 27, 2013 (JP) ..... 2013-036617

(51) Int. Cl.
*H04R 3/00* (2006.01)
*H04R 1/32* (2006.01)

(52) U.S. Cl.
CPC ..... *H04R 3/005* (2013.01); *H04R 1/326* (2013.01)

(58) Field of Classification Search
CPC ..... H04R 3/005; H04R 1/326
USPC ..... 381/26
See application file for complete search history.

(56) References Cited

U.S. PATENT DOCUMENTS

| | | | | |
|---|---|---|---|---|
| 3,255,317 | A * | 6/1966 | Nakanishi | 381/26 |
| 4,334,740 | A * | 6/1982 | Wray | 352/11 |
| 4,466,117 | A * | 8/1984 | Gorike | 381/26 |
| 4,984,087 | A * | 1/1991 | Fujimura et al. | 348/348 |
| 2006/0239475 | A1 * | 10/2006 | Kubota | 381/111 |
| 2011/0194703 | A1 * | 8/2011 | Akino et al. | 381/26 |
| 2012/0063613 | A1 * | 3/2012 | Sato et al. | 381/92 |
| 2013/0216046 | A1 * | 8/2013 | Ikeda et al. | 381/26 |

FOREIGN PATENT DOCUMENTS

| | | |
|---|---|---|
| JP | 2001-028795 | 1/2001 |
| JP | 2012-178628 | 9/2012 |

* cited by examiner

*Primary Examiner* — Angel Castro
(74) *Attorney, Agent, or Firm* — Whitham Curtis Christofferson & Cook, PC

(57) ABSTRACT

A condenser stereomicrophone includes a mid condenser microphone unit that is connected to left and right side condenser microphone units such that the output from the mid condenser microphone unit is applied to the left and right side condenser microphone units. The left and right side condenser microphone units are connected to left and right-channel connector terminals, respectively; and the left and right-channel connector terminals are connected to the mid condenser microphone unit via corresponding power-supply resistors.

10 Claims, 5 Drawing Sheets

CONDENSER STEREOMICROPHONE

BACKGROUND OF THE INVENTION

1. Technical Field

The present invention relates to a condenser stereomicrophone adoptive to plug-in power.

2. Background Art

Condenser stereomicrophones have microphone capsules or electroacoustic transducers that have significantly high output impedances. The output impedances are reduced through impedance converters. An impedance converter is usually equipped with a field-effect transistor (FET). Thus, a condenser microphone requires a power source for the operation of the FET in the impedance converter.

A microphone capsule of a condenser microphone is an electroacoustic transducer that consists of a condenser having a diaphragm and a fixed electrode which face each other and converts the vibration of the diaphragm by acoustic waves into electrical signal. A microphone capsule is also referred to as a microphone module. The term "microphone capsule" will be used in the specification. The microphone capsule and the impedance converter constitute a condenser microphone unit. The condenser microphone unit is accommodated in a microphone case. A microphone includes a microphone unit, a front mesh, a circuit board, and other components.

A professional-use condenser microphone is connected to an external phantom power supply via a connector, for example three-pin XLR connector. A phantom power supply is aimed to supply a polarization voltage to the condenser microphone, and can also be used as a power source of the impedance converter.

The use of the phantom power supply is unintended for condenser microphones connected to conventional consumer-use IC recorders and video recorders (which, hereinafter, are collectively referred to as recording devices). A mechanism has been employed in microphones for receiving electrical power from a power source in a recording device through a plug of the microphone in connection with a microphone jack in the recording device. Such a mechanism is referred to as plug-in power.

Stereomicrophones record and reproduce three-dimensional sounds by recording left and right channels separately. A known stereomicrophone has a single housing accommodating microphone capsules for the left and right channels. A mid/side (MS) stereomicrophone with narrow directionality has a mid capsule and side capsules, the mid capsule having a directional axis extending along the main axis of the microphone body, and the side capsules having directional axes in the direction orthogonal to the main axis.

The side capsules of a conventional MS stereomicrophone have bidirectionality. Unfortunately, bidirectional microphone capsules are expensive. Thus, the inventors have proposed a narrow-directionality stereomicrophone having a mid capsule and two unidirectional microphone capsules (refer to PTL 1, Japanese Unexamined Patent Application Publication No. 2012-178628). According to PTL 1, the two unidirectional microphone capsules are arranged such that their directional axes are symmetrical about the main axis of the microphone body.

PTL 1 provides the narrow-directionality, which is the original target, of the stereomicrophone, but does not consider plug-in power. Plug-in power can be established in the invention according to PTL 1 only by providing a source terminal VDD in addition to the left and right signal output terminals, as illustrated in the drawings in PTL 1.

For example, the right or left output terminal may be connected to the source terminal VDD in the circuit illustrated in the circuit diagram in PTL 1 to establish plug-in power. Such a connection will cause an imbalance in impedance between the right and left output terminals and thus a difference in intensity between the left and right audio outputs, failing to produce satisfactory stereo output. The output signals from the right and left output terminals connected to the source terminal VDD are identical. In other words, the overall output signal obtained through the connection is a monaural signal.

The output terminals and the source terminal VDD may be connected with resistors in the circuit illustrated in the circuit diagram of PTL 1. In such a case, the resistor connecting the right output terminal and the source terminal VDD is set to be the same as the resistor connecting the left output terminal and the source terminal VDD. In this way, the plug-in power is established through the electrical power supplied from the recording device to the condenser microphone unit through the source terminal VDD connected to the right and left output terminals via the resistors. In such a configuration, however, the resistors restrict the current supplied to the source terminal VDD, and thus an insufficient current is supplied to the active devices, such as an FET, in the impedance conversion circuit. The configuration described above results in low left and right output levels.

A zoom microphone is also disclosed that can support plug-in power and can be used as a stereomicrophone (refer to PTL 2, Japanese Unexamined Patent Application Publication No. 2001-28795). The zoom microphone according to PTL 2 includes a central microphone, left and right channel microphones, resistors R1 and R2 connected in series with the left and right channel microphones, and a selector switch. The selector switch switches the recording mode. There are two recording modes: a zoom mode in which the central microphone is connected to connection points of the resistors R1 and R2, and a stereo mode in which the central microphone is disabled by grounding the connection points of the resistors R1 and R2.

The zoom microphone according to PTL 2 is adaptive to plug-in power. The zoom mode combines the output of three microphones, i.e., the central microphone and the left and right channel microphones. Thus, the zoom microphone according to PTL 2 cannot output left and right stereo signals. The zoom microphone according to PTL 2 collects sounds over a wide angle in the stereo mode. Thus, the zoom microphone according to PTL 2 cannot be used as a narrow-directionality stereomicrophone with plug-in power.

SUMMARY OF THE INVENTION

An object of the present invention is to provide a narrow-directionality condenser stereomicrophone adoptive to plug-in power.

A condenser stereomicrophone comprises a mid condenser microphone unit having a directional axis disposed parallel to a main axis of a microphone body; and a left side condenser microphone unit and a right side condenser microphone unit having directional axes disposed orthogonal to the main axis and symmetrically about the main axis, the mid condenser microphone unit, the left side condenser microphone unit, and the right side condenser microphone unit being connected such that the output from the mid condenser microphone unit is applied to the left side condenser microphone unit and the right side condenser microphone unit, the left side condenser microphone unit being connected to a left-channel connector terminal, the right side condenser microphone unit being connected to a right-channel connector terminal, and the left-channel connector terminal being connected to the mid condenser microphone unit via a first power-supply resistor and the right-channel connector terminal being connected to the mid condenser microphone unit via a second power-supply resistor.

The present invention provides a narrow-directionality condenser stereomicrophone adoptive to plug-in power.

DESCRIPTION OF THE PREFERRED EMBODIMENTS

A condenser stereomicrophone according to embodiments of the present invention will now be described with reference to the drawings.

First Embodiment

Figure 1:
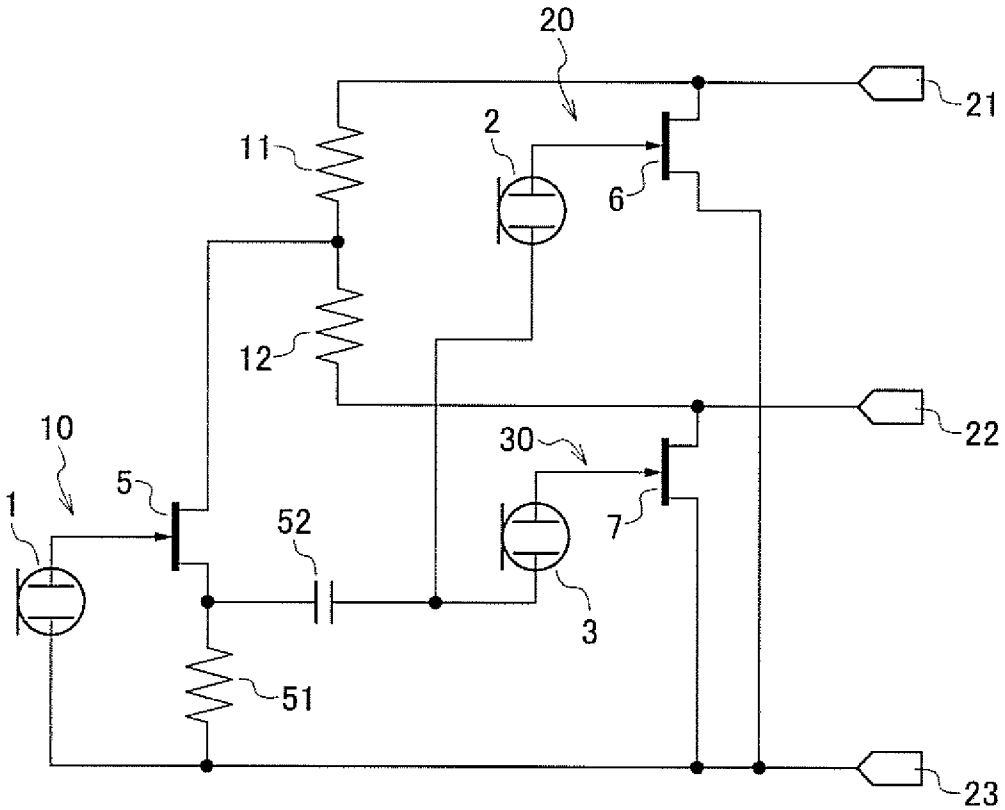
FIG. 1 is a circuit diagram illustrating a condenser stereomicrophone according to a first embodiment of the present invention.
Figure 2:
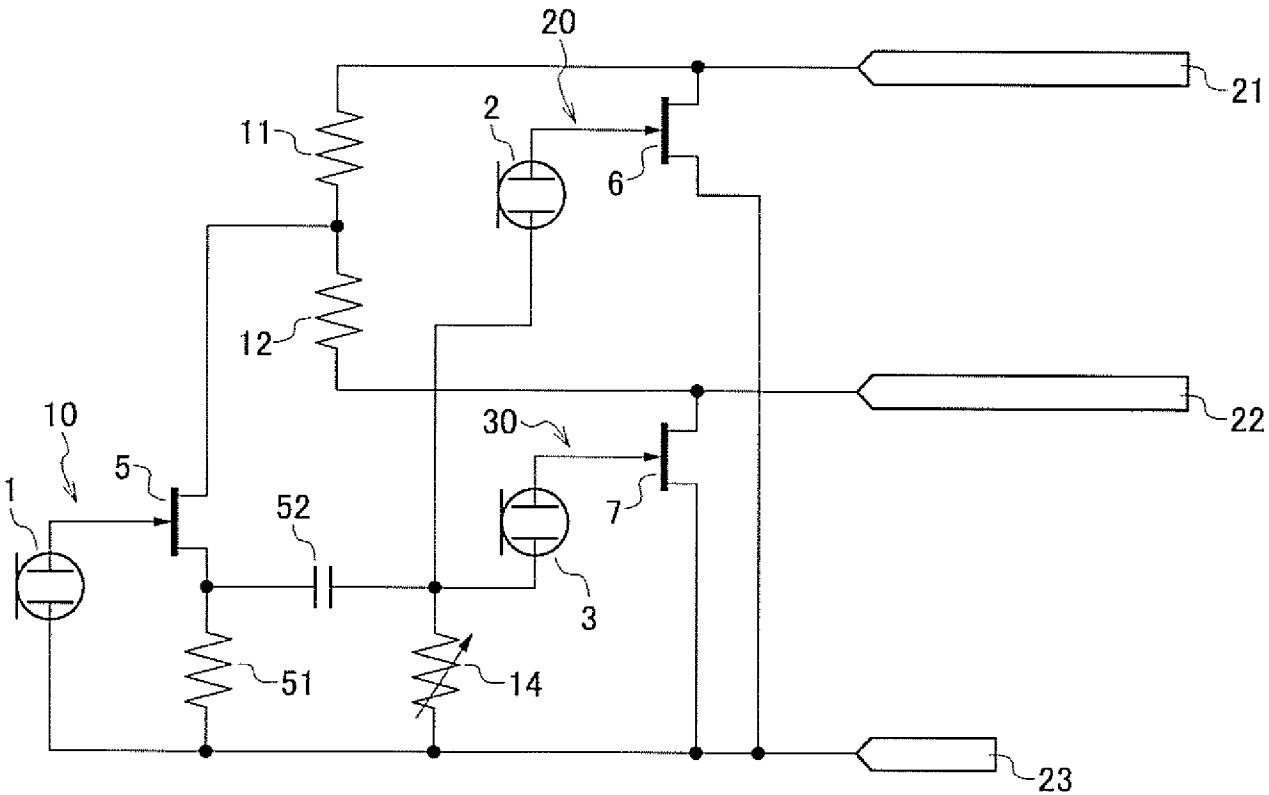
FIG. 2 is a circuit diagram illustrating a condenser stereomicrophone according to a second embodiment of the present invention.

FIG. 1 illustrates a circuit diagram including condenser microphone capsules 1, 2, and 3. The condenser microphone capsules 1, 2, and 3 each include a diaphragm that vibrates upon reception of acoustic waves, a fixed electrode facing the diaphragm with a minute gap, and a housing storing the diaphragm and the fixed electrode. The condenser microphone capsules 1, 2, and 3 are known electroacoustic transducers. The condenser microphone capsules 1, 2, and 3 each convert the capacitances between the diaphragm and the fixed electrode to electrical signals. The vibration of the diaphragm by acoustic waves varies the capacitance between the diaphragm and the fixed electrode. This variation converts the acoustic waves into electrical signals. The condenser microphone capsule 1, for example, has narrow-directionality. The condenser microphone capsules 2 and 3 may have unidirectionality.

The condenser microphone capsules 1, 2, and 3 have significantly high output impedances. Thus, FETs 5, 6, and 7 each operate as impedance converter. And FETs 5, 6, and 7 convert the output impedances to output audio signals. The condenser microphone capsule 1 and the FET 5 constitute a condenser microphone unit 10. The condenser microphone capsule 2 and the FET 6 constitute a condenser microphone unit 20. The condenser microphone capsule 3 and the FET 7 constitute a condenser microphone unit 30.

The condenser microphone unit 10 is a mid condenser microphone unit. The directional axis of the condenser microphone unit 10 is parallel to the main axis of the microphone body. Specifically, the directional axis of the condenser microphone unit 10 is aligned with the main axis of the microphone body. The condenser microphone unit 20 is a left side condenser microphone unit. The condenser microphone unit 30 is a right side condenser microphone unit. The directional axes of the right and left side condenser microphone units 20 and 30 extend in the direction orthogonal to the main axis of the microphone body. The left side condenser microphone unit 20 and the right side condenser microphone capsule 30 are symmetric about the main axis of the microphone body.

The diaphragm and the fixed electrode of the condenser microphone capsule 1 are the output terminals of the condenser microphone capsule 1. One of the output terminals (for example, fixed electrode) is connected to the gate of the FET 5, and the other output terminal (for example, diaphragm) is grounded. The drain of the FET 5 is connected to a left-channel connector terminal 21 via a power-supply resistor 11. The drain of the FET 5 is connected to a right-channel connector terminal 22 via a power-supply resistor 12. The source of the FET 5 is grounded via a source resistor 51 and connected to the output terminals of the condenser microphone capsules 2 and 3 via the condenser 52. The diaphragms and fixed electrodes of the condenser microphone capsules 2 and 3 are also output terminals. One (for example, diaphragm) of the output terminals of each of the condenser microphone capsules 2 and 3 is connected to the source of the FET 5. More specifically, the output of the mid condenser microphone unit 10 is applied to the outputs of the left side condenser microphone unit 20 and the right side condenser microphone unit 30. The power-supply resistor 11 and the power-supply resistor 12 have same values.

The output terminal (for example, fixed electrode) of the condenser microphone capsule 2 is connected to the gate of the FET 6. The output terminal (for example, fixed electrode) of the condenser microphone capsule 3 is connected to the gate of the FET 7. The drain of the FET 6 is connected to the left-channel connector terminal 21. The drain of the FET 7 is connected to the right-channel connector terminal 22. The sources of the FETs 6 and 7 are grounded. A ground terminal 23 is grounded.

The left-channel connector terminal 21, the right-channel connector terminal 22, and the ground terminal 23 constitute a three-contact connector or stereo mini plug, for example. The three-contact connector connected to a connector of a recording device, such as an IC recorder or video recorder, inputs audio signals from the left and right channels to the recording device via the connector terminals 21 and 22. At the same time, the ground terminal 23 of the microphone is connected to the ground of the recording device.

The connector terminals of the recording device connected to the connector terminals 21 and 22 are connected to the power source of the recording device. The electrical power from the power source of the recording device is supplied to the drain of the FET 6 via the connector terminal 21. The electrical power from the power source of the recording device is supplied to the drain of the FET 7 via the connector terminal 22. The electrical power from the power source of the recording device is supplied to the drain of the FET 5 via the connector terminal 21 and the power-supply resistor 11. The electrical power from the power source of the recording device is supplied to the drain of the FET 5 via the connector terminal 22 and the power-supply resistor 12.

The condenser stereomicrophone has a microphone case accommodating the mid condenser microphone unit 10, the left and right side condenser microphone units 20 and 30, and the accompanying resistors and condensers. The connector terminals 21, 22, and 23 may be fixed to the microphone case or otherwise attached to the tip of a cable extracted from the microphone case.

The connector of the microphone connected to the recording device supplies electrical power from the power source of the recording device to the drains of the FETs 6 and 7 via the connector terminals 21 and 22, as described above. The FETs 6 and 7 then carry out desired impedance conversion. The electrical power from the power source applied to the connector terminals 21 and 22 is supplied to the drain of the FET 5 through the power-supply resistors 11 and 12 and the connection point of the power-supply resistors 11 and 12. The FET 5 then carries out desired impedance conversion.

The FET 5 is connected to the mid condenser microphone capsule 1. The part of the circuit diagram shown in FIG. 1 connected to the source of the FET 5 constitutes a signal applying system for applying the signals. The signal applying system outputs from the mid condenser microphone unit 10 to the left and right side condenser microphone units 20 and 30. Appropriately set values of the power-supply resistors 11 and 12 isolates a power supply system for supplying electrical power to the drain of the FET 5 from the signal application system. The separation of the left and right channel signals cause no practical problems because the power supply system for supplying electrical power to the drain of the FET 5 only has a slight influence on the left and right channel signals.

The operation of the first embodiment will now be described. The condenser microphone capsule 1 and FET 5 constitute the mid condenser microphone unit 10. The condenser microphone capsule 1 is connected to the FET 5, which is used as a impedance converter, so as to create low output impedance. The output impedance from FET 5 is lower than the output impedance from condenser microphone capsule 1.

This signal output from the mid condenser microphone unit 10 is input to the gate of the FET 6 via the condenser 52 and the condenser microphone capsule 2. This signal output from the condenser microphone unit 10 is also input to the gate of the FET 7 via the condenser 52 and the condenser microphone capsule 3. The FETs 6 and 7 are common-source. The FET 6 performs impedance conversion on the condenser microphone capsule 2, and outputs the combined signal of the single output from the condenser microphone unit 10 and the signal output from the condenser microphone capsule 2 to the left-channel connector terminal 21. The FET 7 performs impedance conversion on the condenser microphone capsule 3, and outputs the combined signal of the single output from the condenser microphone unit 10 and the signal output from the condenser microphone capsule 3 to the right-channel connector terminal 22.

The condenser microphone capsule 1 has a directional axis parallel to the main axis of the microphone body and has narrow directionality. The condenser microphone capsule 2 has a directional axis tilting 90° to the left from the main axis and has unidirectionality. A signal from the FET 6 to the connector terminal 21 is a narrow-directional signal tilting to the left, like the left channel output of a conventional narrow-directionality MS stereomicrophone. A signal from the FET 7 to the connector terminal 22 is a narrow-directional signal tilting to the right, like the right channel output from a conventional narrow-directionality MS stereomicrophone. As a result, narrow-directionality stereo signals are output from the connector terminals 21 and 22.

The phases of the signals output from the condenser microphone units 10, 20, and 30 will now be described. The signal from the mid condenser microphone capsule 1 has a positive phase. The signal from the FET 5 has a positive phase because the signal is output from the source of the FET 5. The left and right side condenser microphone capsules 2 and 3 are disposed sufficiently close to the condenser microphone capsule 1. Thus, their outputs also have positive phases. The signal from the FET 5 to the FETs 6 and 7 and the signals from the left and right side condenser microphone capsules 2 and 3 are added in positive phases.

The phase of the signal from FET 6 is reversed because the FET 6 is common-source and the signal is output from the drain. Thus, a signal having a reversed phase is applied to the connector terminal 21. The signal applied to the connector terminal 21 from the drain of the FET 5 via the power-supply resistor 11 also has a reversed phase. The signals from the FETs 6 and 5, which have reversed phases, are combined and applied to the connector terminal 21. Similarly, the signals from the FETs 7 and 5, which have reversed phases, are combined and applied to the connector terminal 22.

According to the embodiment illustrated in FIG. 1, the signals from the mid condenser microphone unit 10 and the left and right side condenser microphone units 20 and 30 are not canceled out because of no different phase. Thus, a high output level is achieved.

As described above, the MS condenser stereomicrophone according to this embodiment, which is illustrated in FIG. 1, includes a mid condenser microphone unit 10, and left and right side condenser microphone units 20 and 30. The MS condenser stereomicrophone has narrow directionality. According to this embodiment, the connection between the microphone and the recording device via a connector supplies electric power from the recording device. In this way, plug-in power is established.

Second Embodiment

A condenser stereomicrophone according to a second embodiment of the present invention will now be described with reference to FIGS. 2 to 5. The second embodiment differs from the first embodiment in that a directional variable resistor 14 is provided. The directional variable resistor 14 is disposed between the ground and the point where the output of the mid condenser microphone unit 10 are applied to the left and right side condenser microphone units 20 and 30. Specifically, the directional variable resistor 14 is disposed between the ground and the contact point of the diaphragms of the condenser microphone capsules 2 and 3 and the condenser 52.

Varying the value of the directional variable resistor 14 adjusts the level of the signal from the mid condenser microphone unit 10 applied to the left and right side condenser microphone units 20 and 30. Such an adjustment changes the level of influence of the mid condenser microphone unit 10 on the left and right side condenser microphone units 20 and 30. This results in a variation in the directionality of the signals applied to the left and right-channel connector terminals 22 and 23.

Figure 3:
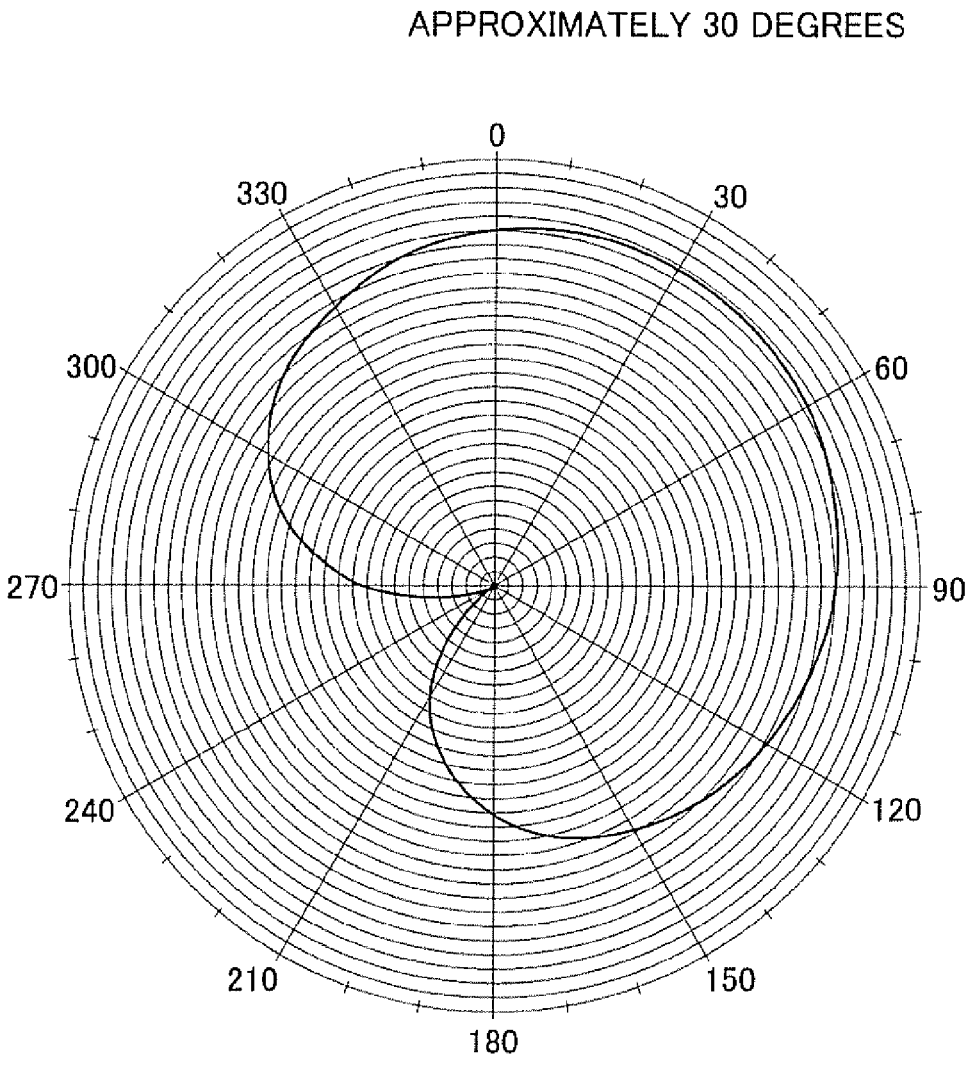
FIG. 3 is a graph exemplifying the directionality after directionality adjustment by a directional variable resistor according to the second embodiment.
Figure 4:
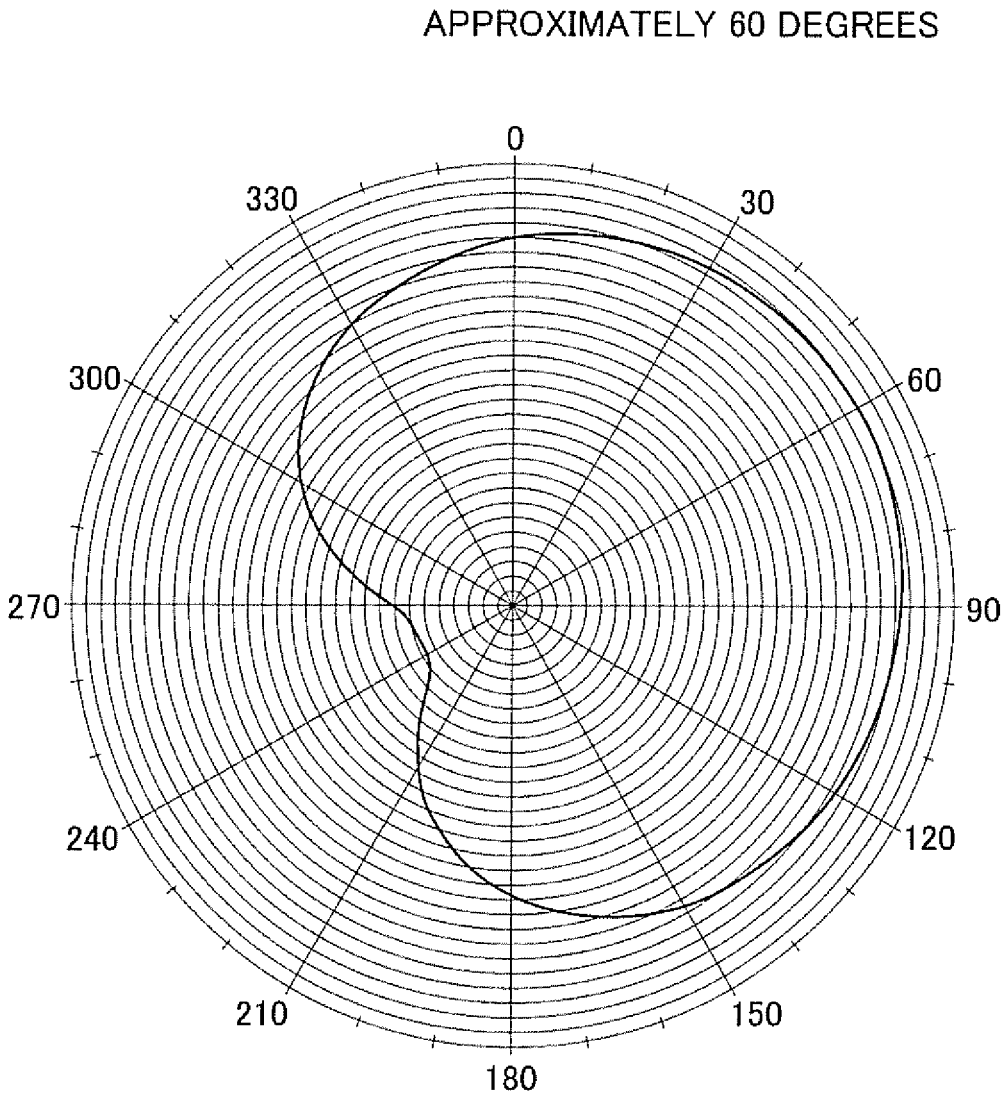
FIG. 4 is another graph exemplifying the directionality after directionality adjustment by a directional variable resistor according to the second embodiment.
Figure 5:
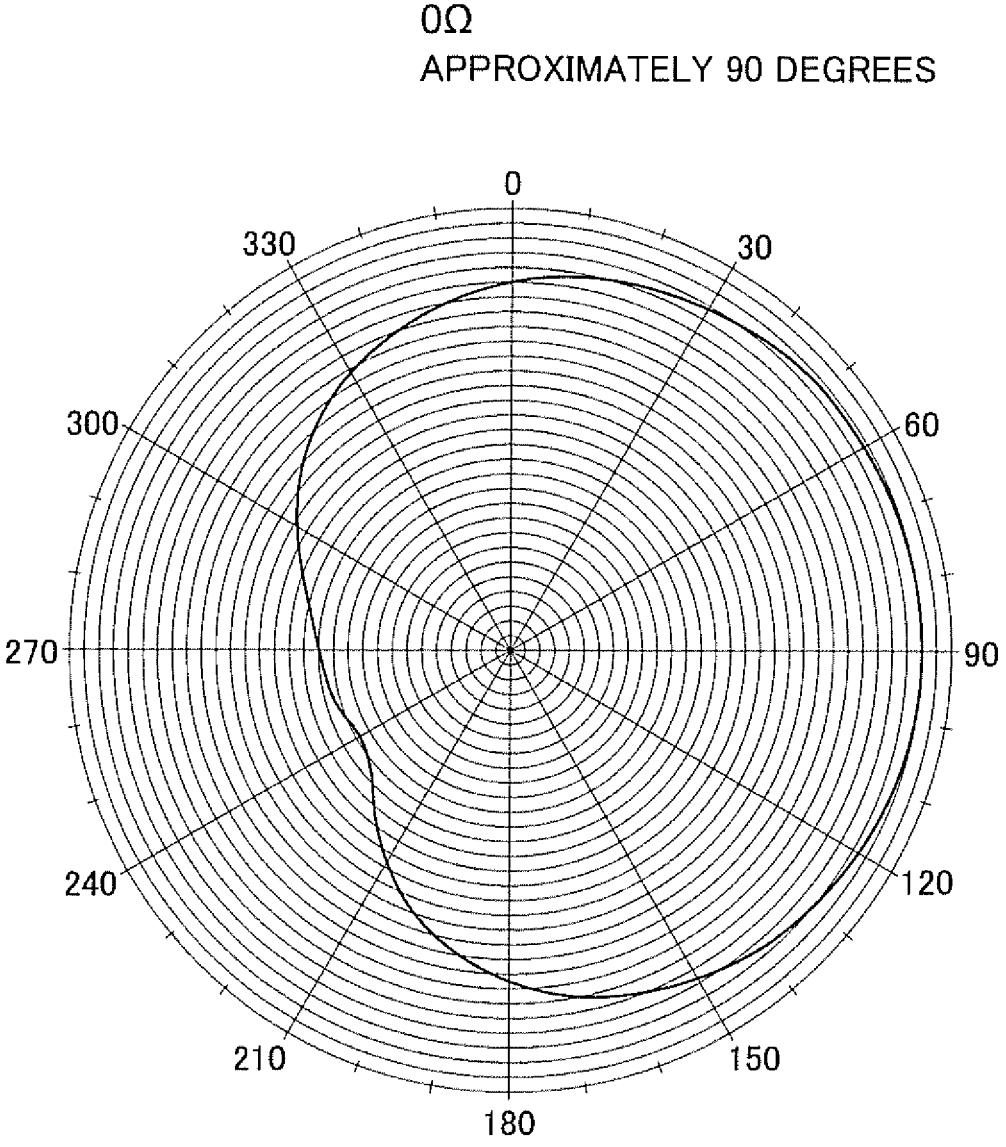
FIG. 5 is another graph exemplifying the directionality after directionality adjustment by a directional variable resistor according to the second embodiment.

FIGS. 3 to 5 illustrate the variation in the directionality of a signal applied to the right-channel connector terminal as a result of a variation in the value of the directional variable resistor 14. FIGS. 3 to 5 illustrate the directionality of only the right channel. The directionality of the left channel, which is not illustrated, is symmetrical to the directionality of the right channel about the straight line including 0 and 180 degrees on FIGS. 3 to 5.

FIG. 3 illustrates the directionality of a signal obtained by setting the directional variable resistor 14 to an appropriate value and increasing the influence of the mid condenser microphone unit 10 on the right side condenser microphone unit 30. As illustrated in FIG. 3, the directionality has a cardioid pattern with the directional axis tilting by approximately 30 degrees. The directional angle is a narrow angle.

FIG. 4 illustrates the directionality of a signal obtained by adjusting the value of the directional variable resistor 14 and lowering the output level of the mid condenser microphone unit 10. The influence of the mid condenser microphone unit 10 on the right side condenser microphone unit 30 is weak because the output from the mid condenser microphone unit 10 branches to the ground. As a result, the directional axis tilts by approximately 60 degrees, as illustrated in FIG. 4, widening the directional range due to deformation of the cardioid.

FIG. 5 illustrates the directionality of a signal output through the directional variable resistor 14 set to zero. In such a case, the output of the mid condenser microphone unit 10 is zero. Thus, audio signals are not affected by the mid condenser microphone unit 10. The right side condenser microphone unit 30 outputs audio signals having directionality unique to the right side condenser microphone unit 30. The directionality of these signals is illustrated in FIG. 5. Specifically, the directional axis tilts by approximately 90 degrees, and the directional angle increases due to the skewed cardioid.

The condenser stereomicrophone according to the second embodiment can readily vary the directionality of signals output from the left and right channels by merely adjusting the value of the directional variable resistor 14.

What is claimed is:

1. A condenser stereomicrophone comprising:

a mid condenser microphone unit having a directional axis disposed parallel to a main axis of a microphone body; and a left side condenser microphone unit and a right side condenser microphone unit having directional axes disposed orthogonal to the main axis and symmetrically about the main axis, wherein the mid condenser microphone unit, the left side condenser microphone unit, and the right side condenser microphone unit are connected such that the output from the mid condenser microphone unit is applied to the left side condenser microphone unit and the right side condenser microphone unit, the left side condenser microphone unit is being connected to a left-channel connector terminal while the right side condenser microphone unit is connected to a right-channel connector terminal, and the left-channel connector terminal is connected to the mid condenser microphone unit via a first power-supply resistor while the right-channel connector terminal is connected to the mid condenser microphone unit via a second power-supply resistor.

2. The condenser stereomicrophone according to claim 1, wherein the mid condenser microphone unit comprises a first microphone capsule and a first field-effect transistor (TET) for output impedance conversion, the left side condenser microphone unit comprises a second microphone capsule and a second FET for output impedance conversion, and the right side condenser microphone unit comprises a third microphone capsule and a third FET for output impedance conversion.

3. The condenser stereomicrophone according to claim 2, wherein, an output terminal of the first microphone capsule of the mid condenser microphone unit is connected to a gate of the first FET, and a drain of the first FET is connected to the left-channel connector terminal via the first power-source resistor and the right-channel connector terminal via the second power-source resistor.

4. The condenser stereomicrophone according to claim 2, wherein, an output terminal of the second microphone capsule of the left side condenser microphone unit is connected to a gate of the second FET, an output terminal of the third microphone capsule of the right side condenser microphone unit is connected to a gate of the third FET, a drain of the second FET is connected to the left-channel connector terminal, and a drain of the third FET is connected to the right-channel connector.

5. The condenser stereomicrophone according to claim 2, wherein, a source side of the FET connected to the first microphone capsule of the mid condenser microphone unit constitutes a signal application system for applying a signal from the mid condenser microphone unit to the left side condenser microphone unit and the right side condenser microphone unit.

6. The condenser stereomicrophone according to claim 5, wherein, a first power supply system and a second power supply system are separated from the signal application system, the first power supply system connecting the left-channel connector terminal to a drain of the second FET in the left side condenser microphone unit and connecting the right-channel connector terminal to a drain of the third FET in the right side condenser microphone unit, the second power supply system connecting the left side connector terminal and the right side connector terminal to a drain of the first FET in the mid condenser microphone unit via the first power-supply resistor and the second power-supply resistor, respectively.

7. The condenser stereomicrophone according to claim 1, wherein the left-channel connector terminal, the right-channel connector terminal, and a grounding terminal constitute a three-terminal connector.

8. The condenser stereomicrophone according to claim 1, further comprising:

a directionality variable resistor that adjusts the directionality of an output from a left channel and an output from a right channel through the adjustment of an output from the mid condenser microphone unit applied to the left side condenser microphone unit and the right side condenser microphone unit.

9. The condenser stereomicrophone according to claim 8, wherein the directionality variable resistor is disposed between a ground and a point at which an output of the mid condenser microphone unit is applied to the left side condenser microphone unit and the right side condenser microphone unit.

10. The condenser stereomicrophone according to claim 1, wherein the left-channel connector terminal and the right-channel connector terminal are adoptive to plug-in power and are connected to a connector of a recording device to supply electrical power from a power source of the recording device to the mid condenser microphone unit, the left side condenser microphone unit, and the right side condenser microphone unit.

* * * * *